United States Patent [19]

Reed et al.

[11] 4,152,108

[45] May 1, 1979

[54] STEAM INJECTION TO ZONE OF ONSET OF COMBUSTION IN FUEL BURNER

[75] Inventors: Robert D. Reed; Richard R. Martin; Hershel E. Goodnight, all of Tulsa, Okla.

[73] Assignee: John Zink Company, Tulsa, Okla.

[21] Appl. No.: 816,189

[22] Filed: Jul. 15, 1977

[51] Int. Cl.[2] ..... F23L 7/00

[52] U.S. Cl. ..... 431/188; 431/163; 431/354; 239/419.5; 239/425

[58] Field of Search ..... 431/4, 190, 163, 202, 431/354, 181, 187, 188; 239/419.5, 425

[56] References Cited

U.S. PATENT DOCUMENTS

| | | | |
|---|---|---|---|
| 399,864 | 3/1889 | Fisk | 431/187 |
| 438,512 | 10/1890 | Wilson et al. | 431/181 |
| 1,817,470 | 8/1931 | Adams | 431/188 |
| 3,180,393 | 4/1965 | Reed | 431/187 |
| 3,994,671 | 11/1976 | Straitz | 431/4 |
| 3,995,986 | 12/1976 | Straitz | 431/4 |
| 4,025,282 | 5/1977 | Reed et al. | 431/4 |
| 4,036,580 | 7/1977 | Reed et al. | 431/4 |

*Primary Examiner*—Carroll B. Dority, Jr.
*Attorney, Agent, or Firm*—Head, Johnson & Chafin

[57] ABSTRACT

Apparatus for burning gaseous and liquid fuels in a furnace, to retard formation of $NO_x$, comprising a fuel tube of selected length and diameter, closed at the end which is inserted into a combustion zone. There are a plurality of ports drilled in the closed end of the fuel tube, the axes of which lie on a conical surface coaxial with the fuel tube. The fuel tube is inserted coaxially into a burner tube of selected larger diameter, and the distant ends are substantially coplanar. A plurality of jets of low pressure steam are injected through a plurality of ports into the annular space between the fuel tube and the burner tube at the outer end of the burner tube. The steam jets flowing through the ports induce a flow of primary combustion air, which mixes with the steam and flows down the annular space to mix with the high velocity jets of fuel as they emerge from the ports on the fuel tube. The fuel, air, and steam mix together prior to entering the combustion reaction zone.

16 Claims, 11 Drawing Figures

STEAM INJECTION TO ZONE OF ONSET OF COMBUSTION IN FUEL BURNER

BACKGROUND OF THE INVENTION

1. Field of the Invention

This invention lies in the field of combustion of fuels in combustion zones.

More particularly this invention lies in the field of apparatus for burning gaseous and liquid fuels with a minimum of $NO_x$ formation.

Still more particularly, this invention involves the mixture of steam and air with the fuel, which may be liquid or gas, as it issues at high velocity from nozzles in a fuel tube, prior to entering the combustion zone.

2. Description of the Prior Art

The well known fact that oxides of nitrogen ($NO_x$) occur to varying degrees in all combustion effluent gases is cause for concern, and government regulatory commissions are setting allowable concentrations of $NO_x$ to new and lower proposed maximums, as measured in parts per million. It is important therefore to minimize the formation of $NO_x$.

SUMMARY OF THE INVENTION

It is the primary object of this invention to provide an apparatus in which low pressure steam and primary combustion air can be mixed with the fuel prior to entering the combustion zone, whereby combustion will take place with a minimum quantity of $NO_x$ formed.

This and other objects are realized and the limitations of the prior art are overcome in this invention by providing a fuel tube through which gaseous or liquid fuel can be provided, under pressure, to issue from a plurality of nozzles or ports drilled with their axes in radial planes and at a selected angle with the axis of the fuel tube. Fuel issuing from these ports flows along the surface of a cone, producing a thin conical wall of fuel, which is ignited at some distance from the point of issuance of the fuel from the port.

The fuel tube is positioned coaxially, and internally, of a larger diameter pipe, termed a burner tube. In the annular space between the fuel tube and burner tube there is a flow of steam and air mixed together, at considerable velocity, which flows to intersect the jets of fuel close to their point of issuance from the ports, where they are moving at high velocity, so that there will be intimate turbulent mixing of the steam and air with the fuel, prior to entering the combustion zone.

In one embodiment, the steam is injected into the annular space through a plurality of ports drilled through the burner tube from an annular plenum surrounding the burner tube, to which steam is provided at low pressure.

Ten pounds gauge or less is sufficient pressure to provide adequate velocity for inducing primary air flow into the annular space, and to provide sufficient velocity to turbulently mix with the fuel jets as they leave the fuel ports, prior to combustion.

In another embodiment, the steam jets issue from an annular plenum surrounding the fuel tube but positioned axially apart from the end of the fuel tube. The jets of steam issue substantially longitudinally into the annular space, and induce air flow with the steam, to mix and flow down the annular space.

In a third embodiment, the jets of fuel and steam are injected into the open end of the burner tube, which connects at its distant end to a burner inserted through a wall of a furnace, for example. The steam jets and fuel jets induce primary air flow and all three components are turbulently mixed as they flow down the burner tube to the burner, at the distal end.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
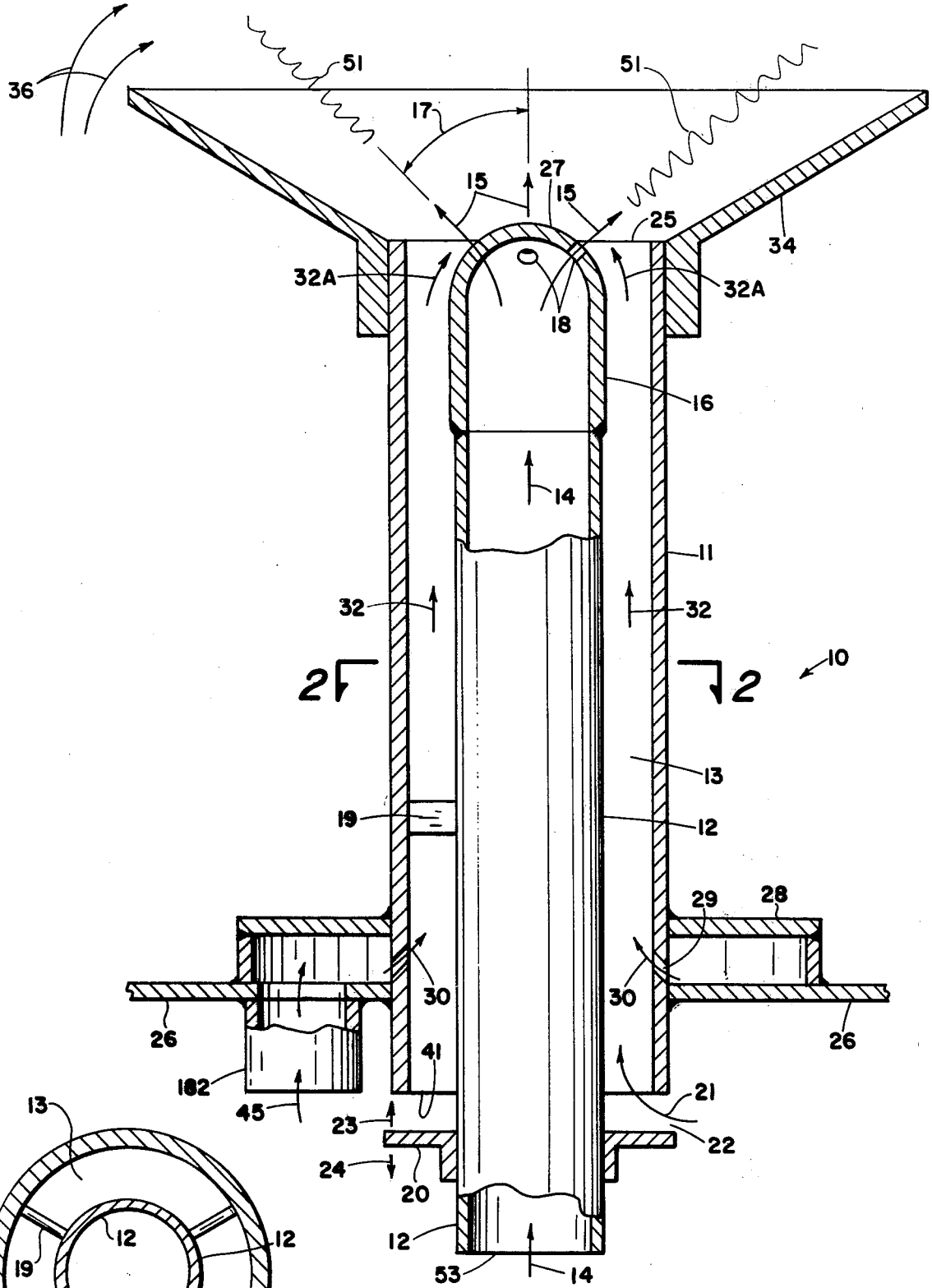
FIG. 1 shows a first embodiment of the invention.

Referring now to the drawings and in particular to FIG. 1 there is shown a first embodiment of this invention, illustrated generally by the numeral 10. It includes a fuel tube 12, of selected diameter and length, through which fuel such as a gas, can flow in accordance with arrows 14. The distal end, which is inserted into an opening in a furnace wall (not shown) is closed by a member 16. A plurality of orifices, or ports 18 are drilled in the closed end of the member 16. These are drilled in radial planes at a selected angle 17 with the axis of the fuel tube. Thus when fuel is applied under pressure to the interior of the tube 12, there will be a plurality of jets of fuel flowing in accordance with arrows 15, that will form substantially a thin conical wall of fuel.

A burner tube 11 of steel, of somewhat larger diameter than the fuel tube 12, is coaxial with the fuel tube, and their distal ends 25, 27 are substantially coplanar. Radial spacer means, such as 19 are provided for centralizing the fuel tube in the burner tube so that there is an annular space 13 between the tubes.

At its outer end the fuel tube 12 extends beyond the end 41 of the burner tube. There may be a sliding air door 20, which can be moved in accordance with the arrows 23 and 24, to provide a larger or smaller space 22 between the door and the end 41 of the burner tube. Thus, the amount of primary air 21 which enters through that space 22 can be controlled.

An annular plenum 28 is welded to, and surrounds the burner tube, near its outer end 41. A plurality of orifices, or ports 29 are drilled at an angle into and through the burner tube, circumferentially spaced, such that when steam is supplied to the plenum 28 in accordance with arrow 45, it will flow in accordance with arrows 30 into the annular space 13, and will induce the flow of primary air 21, into the annular space. The air will mix with the steam and they will flow in accordance with arrows 32, as a mixture of steam and air, along the burner tube. At the distal end 25, where the fuel will be flowing from the ports in accordance with arrows 15, because of the high velocity of the fuel, the pressure will be low and there will be a flow of steam and air in accordance with arrows 32A, into the fuel, where it will turbulently mix, prior to the combustion zone, which will be downstream of the flow, a selected distance, as the velocity of the fuel decreases below the high velocity with which it leaves the ports. Numeral 51 indicates the conical wall of fuel, plus steam, plus air in the combustion zone and this flow induces an additional flow of secondary air in accordance with arrow 36, around a conical shield 34 which is attached to the distal end of the burner tube 11.

Figure 10:
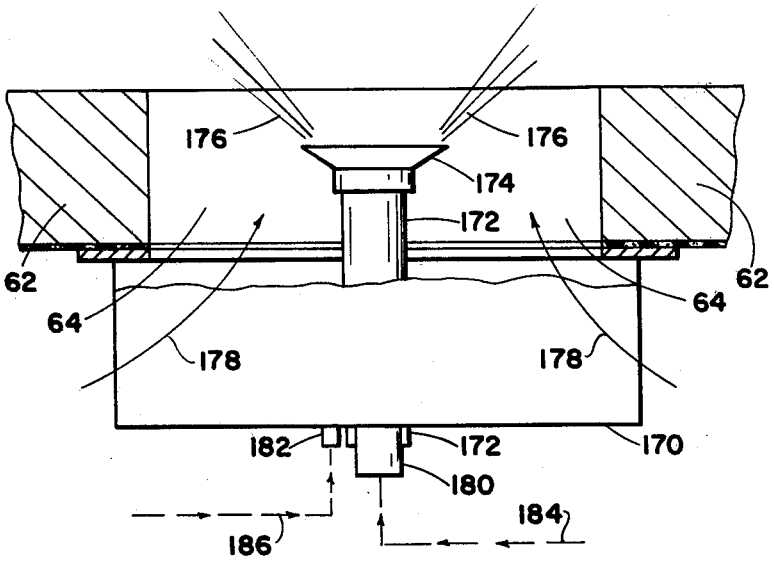
FIG. 10 illustrates a detail of the secondary air control.

Referring briefly to FIG. 10, there is shown a conventional furnace wall 62 with an opening 64 into which the burner tube, indicated by numeral 172 and the conical shield 174 is inserted. The structure indicated by numeral 170 is an air register, which is attached to the furnace wall, and at its outer end supports the plate 26 of FIG. 1, which is part of the plenum, and which is attached to the burner tube. It is the air register which supports the burner assembly as shown in FIG. 1.

Further in connection with FIG. 10 the fuel tube 180 has fuel supplied by pipe means indicated by the dashed line 184 and the steam plenum has an inlet pipe 182 through which steam is supplied in accordance with numeral 186. All of this is conventional construction. The improvement lies in the details of the burner assembly as shown in FIG. 1.

Figure 2:
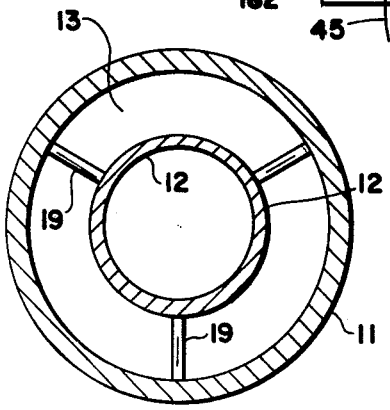
FIG. 2 shows a cross-section taken along the plane 2—2 of FIG. 1.

FIG. 2 illustrates a cross-sectional view taken along the plane 2—2, which shows the fuel tube 12 supported internally of the burner tube 11 by radial support means 19.

Figure 3:
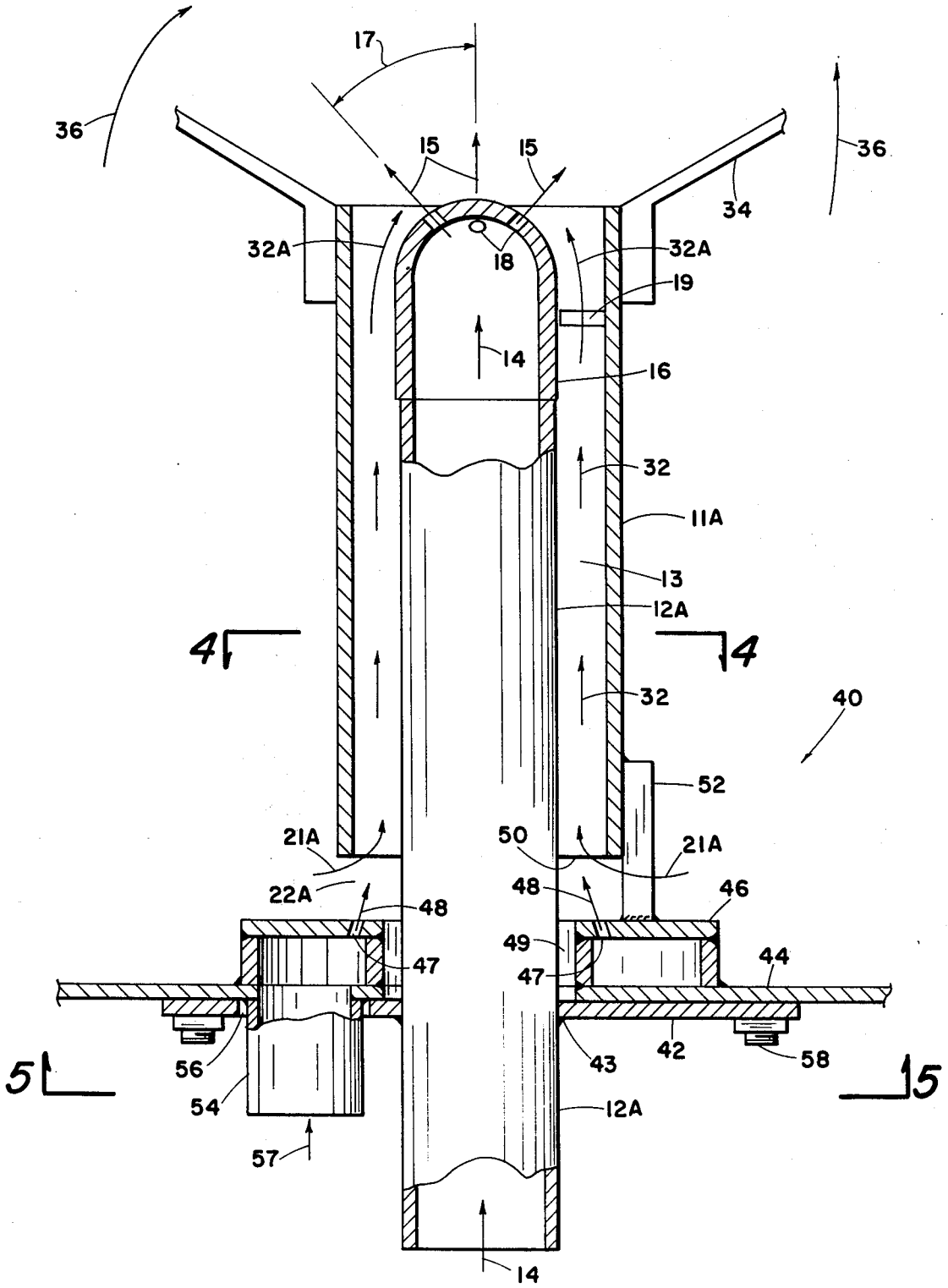
FIG. 3 shows a second embodiment of the invention.

Referring now to FIG. 3, there is shown a second embodiment of this invention which is somewhat similar to FIG. 1 in that it comprises a fuel tube 12A centered internally of a burner tube 11A by support means 19 etc. Fuel is supplied in accordance with arrow 14 and flows along the fuel tube to the end fixture 16, which has a plurality of angular ports 18 through which the fuel flows in accordance with arrows 15. The axes of the ports are drilled at a selected angle 17 to the axis of the fuel tube.

In this embodiment the burner tube is cut shorter with its outer end indicated by the numeral 50. The steam plenum in this embodiment is attached by means of screws 58 to the plate 42, which is welded to the fuel tube. The plate 44 supports the steam plenum 46 and the top plate of the steam plenum supports the burner tube in accordance with the legs 52 which are welded to the burner tube and to the plenum. There is a narrow annular space 49 between the inner wall of the annular steam plenum 46 and the fuel tube 12A. A plurality of orifices 47 are drilled in the outer plate of the steam plenum so that jets of low pressure steam will flow in accordance with arrow 48 more or less longitudinally into the open end 50 of the burner tube. This will induce an air flow into the opening 22A between the plenum 46 and the end 50 of the burner tube.

As in FIG. 1, the low pressure steam is supplied to the plenum by means of the pipe 54 and steam flows in accordance with arrows 57 into the plenum 46 and as 48 out of the plenum, into the annular space 13.

Figure 4:
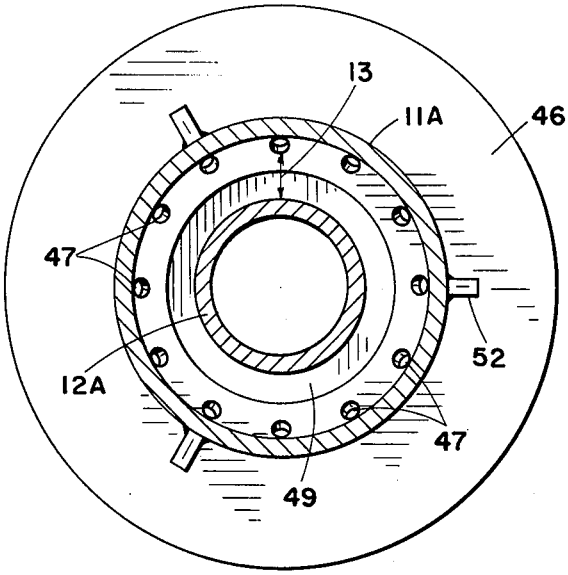
FIGS. 4 and 5 show views taken along the planes 4—4 and 5—5 respectively of FIG. 3.

FIG. 4 is a view along the plane 4—4 of FIG. 3 and further illustrates the construction of the fuel tube 12A, the support legs 52 burner tube 11A and the steam plenum 46.

Figure 5:
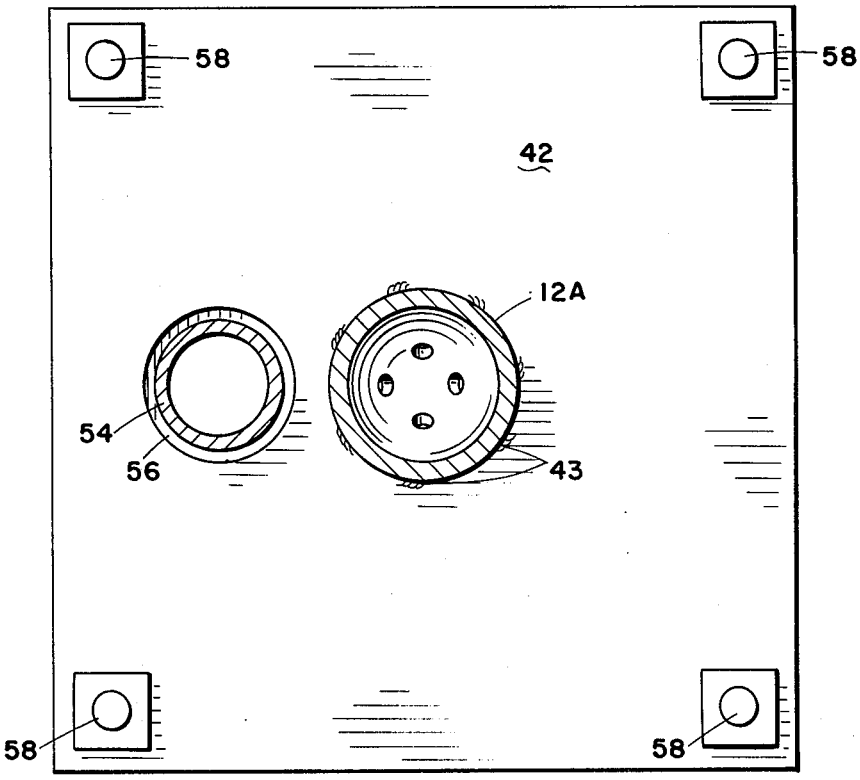

FIG. 5 is a view taken along the plane 5—5 of FIG. 3 and shows the support plate 42 attached to the fuel tube by means of welds 43, the fuel tube 12A and the steam pipe 54, with an annular opening 56 between it and the plate 42.

In FIG. 1, the steam-inspirated air, 21, is drawn from outside the air register (170 of FIG. 10) to supplement the resiter-admitted air, but in FIG. 3, the steam-inspirated air is taken from inside the air register to cause register-control of all air (21A, of FIG. 3, and 178 of FIG. 10) to be subject to air register control. In FIG. 1, the air 21 allows increase in burner capacity because of the presence of a greater quantity of air than can pass through the air register which is 170 of FIG. 10.

Figures 6, 7:
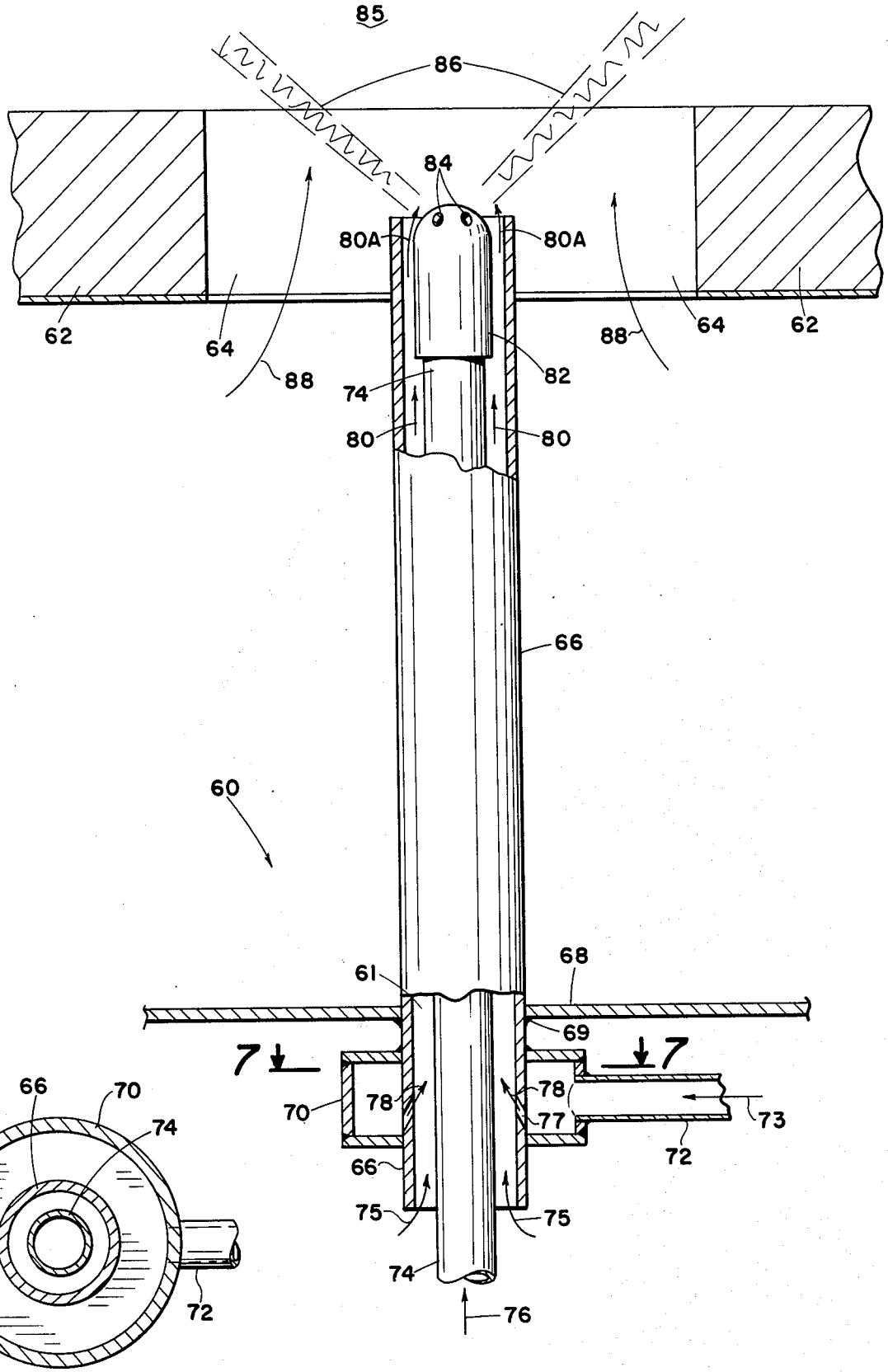
FIG. 6 illustrates an embodiment for use with a liquid fuel.
FIG. 7 illustrates a cross-section view taken along the plane 7—7 of FIG. 6.

FIG. 6 illustrates an embodiment for use with a liquid fuel. The primary difference is an atomizer 82 mounted at the end of the fuel tube 74. The nozzles or ports 84 of the atomizer provide high velocity jets of tiny droplets of fuel which flow along to the surface of a cone 86. The burner tube 66 and steam plenum 70 are pretty much the same as shown in FIG. 1. The burner tube is welded by means 69 to a support plate 68, which would be attached to the air register such as shown in FIG. 10.

The burner assembly indicated by the numeral 60 is inserted into the opening 64 in the wall 62, and the flow of fuel and entrained steam and air indicated as 86 forms a conical flame into the space 86 inside the furnace. The secondary air induced into the opening 64 is illustrated by arrows 88. The air register (not shown in FIG. 6) provides control of the quantity of secondary air. If desired, an air door can be attached to the fuel tube 74 and its outer end to control the amount of primary air 75, flowing into the annular space 61, induced by the steam jets 78 flowing through the ports 77 from the steam plenum 70. Low pressure steam is supplied to the plenum through pipe 72 in accordance with arrow 73. The combined air 75 and steam 78 form a mixture indicated by arrows 80 which flow along the annular space 61 and as arrows 80A mix with the flow of fuel in the region of the nozzles 84 and flow into the combustion zone.

FIG. 7 illustrates a cross-sectional view of the steam plenum along the plane 7—7 of FIG. 6. All parts are numbered the same as in FIG. 6 and no further explanation is needed.

In FIGS. 1, 3 and 6, the steam and air are carried separately and are mixed with the fuel as it issues from the ports of the fuel tube, immediately prior to the combustion.

Figure 8:
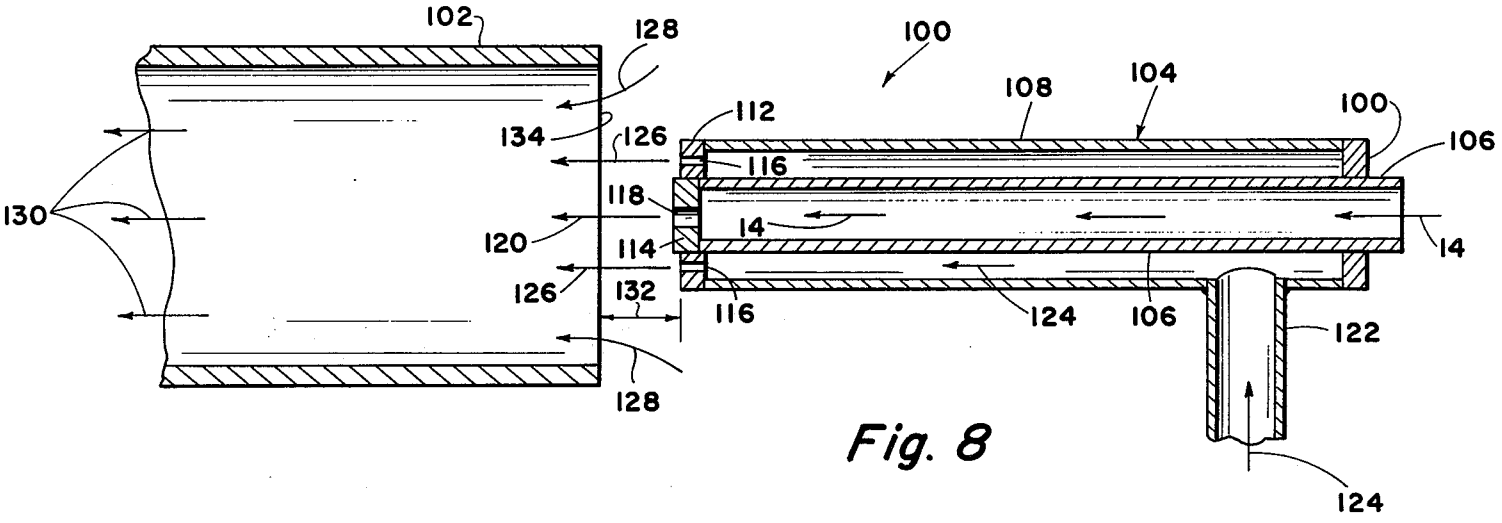
FIGS. 8 and 9 show two additional embodiments in which the fuel, steam, and air are all injected into the end of the burner tube, and thoroughly mix as they flow toward the distal end to issue into the combustion zone.
Figure 9:
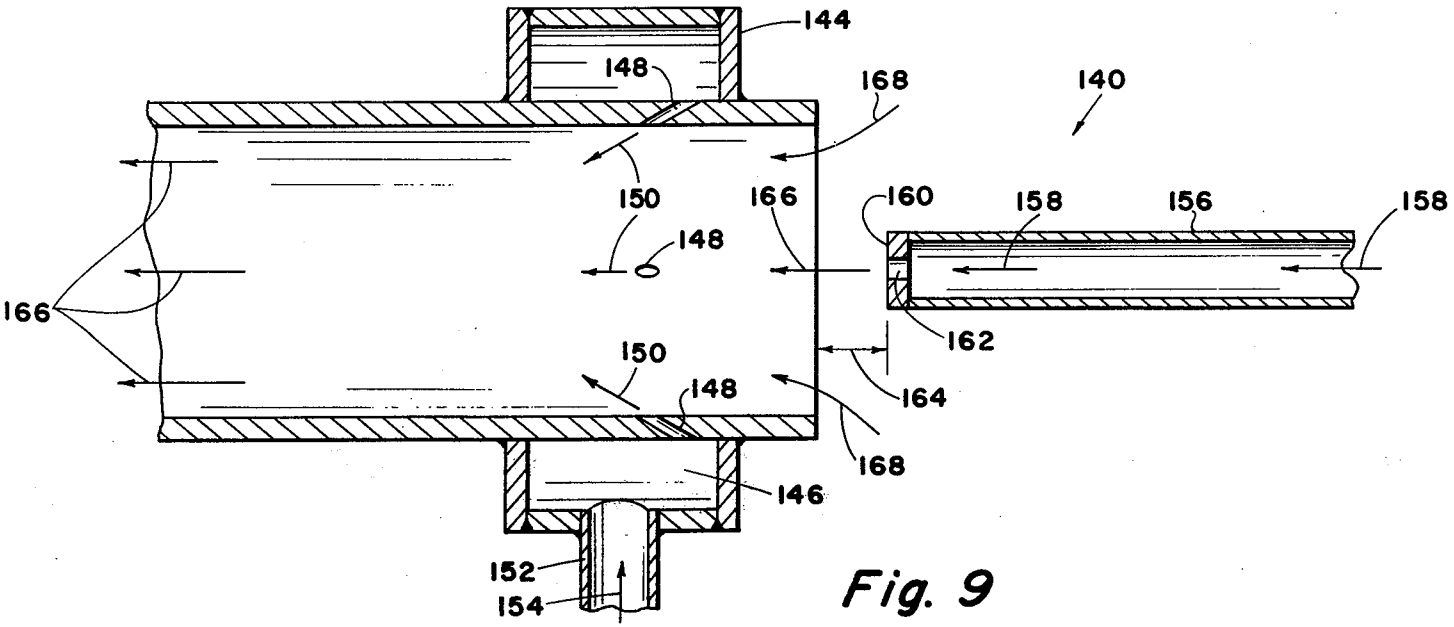

In FIGS. 8 and 9, there are shown two other embodiments which are slightly different from each other, but are similar in the respect that the fuel tube terminates outside of the burner tube, and the burner tube carries to the combustion zone a mixture of fuel, air, and steam, premixed inside of the burner tube.

In FIG. 8, the burner tube is indicated by numeral 102. Coaxial with the burner tube there is a fuel tube 106 and a steam tube 108, which are concentric. Annular plates 110 and 112 close the ends of the steam tube, and plate 114 closes the fuel tube. An inlet pipe 122 for low pressure steam is provided, and steam flows in accordance with arrows 124. At the distal end, which is positioned a selected distance 132 from the end 134 of the burner tube 102, ports 116 are provided in the annular plate 112 for the steam inside of the steam tube 108.

These ports provide jets 126 of steam flowing coaxially into the open end 134 of the burner tube.

Fuel is supplied in accordance with the arrow 14 which flows along the fuel tube, and out of the distal end, through one or more longitudinal ports 118, in accordance with arrows 120. The high pressure of the fuel provides a very high velocity jet of fuel 120, which together with the steam jets 126 induce a primary air flow 128. Within the burner tube 102 the steam, fuel, and air thoroughly and turbulently mix to provide a flow of the mixture axially along the burner tube in accordance with arrows 130 to the distal end, where they emerge into the combustion zone through a conventional burner (not shown).

In FIG. 9, there is shown a variation of the embodiment of FIG. 8, in which the fuel tube 156 is in a similar position to the fuel tube 106 of FIG. 8, with respect to the burner tube 142. In FIG. 9, the steam jets are provided from a steam plenum 144 which is similar to that of FIG. 1. That is, the steam jets are directed through the wall of the burner tube, through ports 148 and flow in accordance with arrows 150. The steam inside space 146 inside of the plenum is supplied by means of a low pressure steam pipe 152, in accordance with arrows 154. Thus, the steam jets 150 and the fuel jets 166 from the distal end of the fuel tube 156 induce a flow of primary air 168. All three components thoroughly mix and flow in accordance with arrows 166, longitudinally in the burner tube to the distal end, where they enter the combustion zone. The burner end of the burner tube is conventional.

Figure 11:
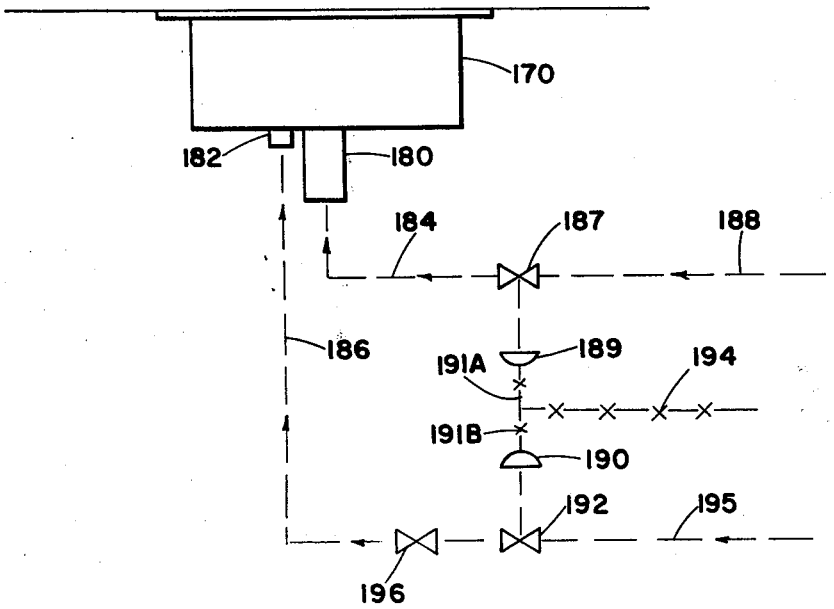
FIG. 11 illustrates a valve control system for the fuel and the steam.

The quantity of steam injected should be proportional to fuel quantity for maintenance of a proper fuel steam ratio for $NO_x$ suppression. The control scheme as indicated in FIG. 11 can be be used to provide this desired weight ratio of fuel to steam. This control system is not novel, but is useful in connection with the present apparatus. It is well known in the art of control, and is not necessarily a part of this invention, except that a suitable control of steam and fuel, on a selected weight ratio basis, is considered to be a part of the invention. The important fact of the invention lies in the means for delivery of steam and primary air to be mixed with the fuel prior, to the initiation of the combustion reaction, for $NO_x$ control.

In FIG. 11 is shown the fuel pipe 188 carrying fuel to the fuel tube 180. This passes through a control valve 187 to provide a flow 184 to the fuel tube. Similarly, the low pressure steam line 195 passes through a control valve 192, and, if desired, through a manually controlled valve 196, to flow in accordance with arrows 186 to the steam inlet 182 of the burner tube. The secondary air register is indicated by a numral 170.

The control line 194 applies a control through 191A and 191B, respectively, to the control 189 of valve 187, and control 190 of valve 192. Thus, whenever the fuel flow rate changes, the steam rate will correspondingly change and the weight ratio will be retained constantly.

It is important to note that is this application, the use of low pressure steam, such as exhaust-steam, is stressed since the steam of that pressure, or source, is all that is required to provide the reduction of $NO_x$, and the cost of low pressure steam is considerably less than would be required if a higher pressure of live steam would be required.

The election of steam delivery on a weight percent basis, rather than a volume percent basis, automatically compensates for fuel being burned. As examples, $CH_4$, 15 weight percent, equals 13.3 volume percent. $C_3H_8$, 15 weight percent, equals 36.6 volume percent. Number 6 oil, 15 weight percent equals 130 volume percent. Note also that a typical weight percent is 15. But if the fuel contains compounds which include bonded nitrogen, such as residual fuel oil or amonia, operation may show need for a greater weight percent of steam for suitable $NO_x$ reduction, in accordance with research results. Through application of this principle, $NO_x$ reductions from 200 PPM to 50 PPM have been found. Such reduction is exemplary and not necessarily typical. Also 15 weight percent is exemplary and not limiting, and can be either a plus or a minus figure.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus for burning gaseous and liquid fuels for NOx suppression in a combustion zone, comprising;

(a) fuel tube means comprising a tube of selected length and diameter closed at the distal end, and having a plurality of ports drilled symmetrically about the axis with the axes of said ports falling on a conical surface of selected angle;

(b) said fuel tube means positioned coaxially in a burner tube of larger diameter, providing an annular space of selected radial dimension therebetween, the distal first ends of said fuel tube and said burner tube substantially in the same plane, the fuel tube extending out of said burner tube at their second ends;

(c) means to flow fuel under pressure into said fuel tube at its second end, whereby said fuel will issue from said ports as a plurality of jets forming a conical wall of fuel;

(d) means to inject a plurality of jets of low pressure steam into the annular space, near said second end of said burner tube;

(e) an enclosed combustion space, an opening in one wall around said space, and means to insert said distal ends of said burner tube and said fuel tube into said opening;

whereby a flow of primary air will be induced into said annular space at said second end of said burner tube, which will mix with said injected steam, and flow as a mixture of steam and air along said annular space to mix with said fuel jets at their points of departure from said fuel tube.

2. The apparatus as in claim 1 including an annular plenum and means to supply steam to said plenum; and including a plurality of ports drilled through a wall of said plenum leading into said annular space.

3. The apparatus as in claim 2 in which said plenum is attached to and encircle said burner tube and said ports are drilled from said plenum through the wall of said plenum and said burner tube into and along said annular space.

4. The apparatus as in claim 2 in which said plenum surrounds said fuel tube and is spaced a selected distance from said second end of said burner tube, and said ports are drilled in plane surface of said annular plenum facing said opening end of said annular space.

5. The apparatus as in claim 1 including a conical wall attached to the distal end of said burner tube, the angle of said conical wall substantially the same as the conical angle of said fuel jets.

6. The apparatus as in claim 1 including adjustable door means to close off the open end of said annular space.

7. The apparatus as in claim 1 and including an air register means over said opening whereby secondary air being induced into said combustion space through said opening can be controlled by said air reigster means.

8. The apparatus as in claim 1 in which said fuel is a gas at a substantial pressure.

9. The apparatus as in claim 1 in which said fuel is a liquid fuel under pressure and including atomizer means.

10. The apparatus as in claim 1 in which said steam is available at a pressure of at least 10# gauge.

11. The apparatus of claim 1 in which said steam is available at pressure as low as 2# gauge.

12. The apparatus as in claim 7 including means for supply of steam-inspirated air from inside the burner air register, whereby said air register controls all air admitted to the presence of fuel, by the total burner structure.

13. The apparatus as in claim 7 including means for supply of steam-inspirated air from outside the burner air register, whereby the air capacity of said air register is increased by virtue of supplementation by steam-inspirated air to the quantity of air delivery of which the air register is capable.

14. Apparatus for burning gaseous fuels with suppression of $NO_x$ formation in a combustion space, comprising;

(a) burner tube means inserted at its first end into an opening in a wall surrounding said combustion space, said burner tube of selected length and diameter;

(b) fuel tube means coaxial with said burner tube means, at least one axial port in the end of said fuel tube adjacent the second end of said burner tube, and means to supply gaseous fuel at substantial pressure to said fuel tube;

whereby at least one jet of gas will flow into the open second end of said burner tube, inducing primary air into said burner tube;

(c) means providing a plurality of steam jets directed into said burner tube near its second end, whereby said steam jets will induce additional primary air;

whereby said gas and steam and primary air will turbulently mix and flow along said burner tubes to said distal end and into said combustion space.

15. The apparatus as in claim 14 in which said means providing said steam jets includes ports drilled through the wall of said burner tube from a steam plenum which surrounds said burner tube.

16. Apparatus for burning gaseous and liquid fuels for NOx suppression in a combustion zone, comprising;

(a) fuel tube means comprising a tube of selected length and diameter closed at the distal end, and having a plurality of ports drilled symmetrically about the axis with the axes of said ports falling on a conical surface of selected angle;

(b) said fuel tube means positioned coaxially in a burner tube of larger diameter, providing an annular space of selected radial dimension therebetween, the distal first ends of said fuel tube and said burner tube substantially in the same plane, the fuel tube extending out of said burner tube at their second ends;

(c) a conical wall attached to the distal end of said burner tube and situate below the conical surface defined by said ports, the angle of said conical wall substantially the same as said selected angle of said ports;

(d) means to flow fuel under pressure into said fuel tube at its second end, whereby said fuel will issue from said ports as a plurality of jets forming a conical wall of fuel;

(e) means to inject a plurality of jets of low pressure steam into said annular space, near said second end of said burner tube;

whereby a flow of primary air will be induced into said annular space at said second end of said burner tube, which will mix with said injected steam, and flow as a mixture of steam and air along said annular space to mix with said fuel jets at their points of departure from said fuel tube.

* * * * *